United States Patent [19]

Bushaw et al.

[11] Patent Number: 4,639,126

[45] Date of Patent: Jan. 27, 1987

[54] METHOD FOR PRODUCING DUPLEX COPY SETS FROM A DUPLEX ORIGINAL SET

[75] Inventors: Kenneth A. Bushaw; Louis A. Bustamante, both of Longmont; James J. McCurry, Boulder, all of Colo.

[73] Assignee: International Business Machines Corporation, Armonk, N.Y.

[21] Appl. No.: 795,950

[22] Filed: Nov. 7, 1985

[51] Int. Cl.[4] ..... G03G 21/00

[52] U.S. Cl. ..... 355/3 SH; 271/3.1; 355/14 SH; 355/24; 355/77

[58] Field of Search ..... 355/3 R, 3 SH, 14 SH, 355/23, 24, 25, 77; 271/3.1, 163

[56] References Cited

U.S. PATENT DOCUMENTS

| | | | |
|---|---|---|---|
| 3,556,513 | 1/1971 | Howard | 271/163 X |
| 4,089,516 | 5/1978 | Colglazier et al. | 271/9 |
| 4,099,150 | 7/1978 | Connin | 355/3 R |
| 4,113,245 | 9/1978 | Colglazier et al. | 271/10 |
| 4,126,305 | 11/1978 | Colglazier et al. | 271/120 |
| 4,140,387 | 2/1979 | Gustafson | 355/14 |
| 4,278,344 | 7/1981 | Sahay | 355/14 SH |
| 4,384,782 | 5/1983 | Acquaviva | 355/3 SH |
| 4,413,901 | 11/1983 | Kollar | 355/3 SH |
| 4,456,235 | 6/1984 | Colglazier et al. | 271/3.1 |
| 4,466,733 | 8/1984 | Pels | 355/14 R |
| 4,512,651 | 4/1985 | Dunleavy | 355/14 SH |

*Primary Examiner*—Fred L. Braun

*Attorney, Agent, or Firm*—Francis A. Sirr

[57] ABSTRACT

A method for producing duplex copies from a duplex original wherein only one copy of the odd or even sides of the original documents is made during the first circulation of the originals to and from the exposure platen. During each subsequent circulation of the original documents, excluding the last circulation, two copies of the odd or even sides of the original are produced and either stored in a buffer tray if one side of the copy sheet is blank or transported to an exit tray if duplex copying has been completed on the copy sheet. Only one copy of the odd or even sides of the original documents are made during the last circulation and transfered to the blank sides of the copy sheets in the buffer tray to complete a duplex copy.

9 Claims, 7 Drawing Figures

METHOD FOR PRODUCING DUPLEX COPY SETS FROM A DUPLEX ORIGINAL SET

FIELD OF THE INVENTION

This invention relates to the field of document reproduction or copying, and to the use of a recirculating original document feeder and a duplex tray to make a number of collated duplex copy sets from a collated duplex original document.

BACKGROUND OF THE INVENTION

The problem of producing duplex copies from duplex originals (i.e., duplex-to-duplex copying) has been addressed in the prior art.

U.S. Pat. No. 4,099,150 discloses a copier having a last-in-first-out (LIFO) duplex tray (51), and a document feeder having upper (57) and lower (63) original document trays. The upper tray is a LIFO tray, whereas the lower tray is a first-in-first-out (FIFO) tray.

A multi-page duplex original document is placed in the document feeder's upper tray, face up (FIG. 4)—i.e., with page 1 facing up. The document is now inverted by feeding the document out of the upper tray, through the copier's exposure area (70) without copying, and into the lower tray (FIG. 5).

Copying now occurs as sheets are fed out of the bottom tray, into the exposure area, and back to the bottom tray. One copy set is made for each circulation of the original document, and the copy set(s) are placed in the duplex tray, odd pages facing down.

Now it is necessary to circulate the original document from the lower tray to the upper tray (FIG. 7), and then from the upper tray to the lower tray (FIG. 8). Only then is the copier ready to place the odd numbered pages on the blank sides of the sheets now residing in the duplex tray.

Again, the original document is circulated through the exposure area once for each copy set.

When finished, the original document resides in the document feeder's lower tray, face up, and the copy sets reside in the copier's exit tray (53), face up.

U.S. Pat. No. 4,140,387 again shows a document feeder having an upper (32) and a lower (33) original document tray. Both of these trays are FIFO trays.

The copier does not include a duplex tray. Rather, a single-sheet-turn-around-device (110) operates to reverse a side-one copy sheet, and then immediately returns the sheet for side-two copying.

The original duplex document is placed in the upper tray, odd pages facing up (FIG. 4). The document is now fed to the bottom tray, where it now resides even pages facing up, but in increasing page sequence (i.e., pages 2, 4, 6 for a six page duplex document). Therefore, the original document is now in scrambled page order, i.e., the page order is not correct when progressing through the document from either direction.

Now copying can begin. The highest numbered even page (i.e., page 6) is first copied. This copy sheet is sent to the turn-around-device (110 of FIG. 5), from where its blank side is returned for copying of the highest numbered odd page (i.e., page 5)—as the document feeder has reversed the original document sheet to present the highest numbered odd page (FIG. 4).

This copy sheet is then placed in the copier's exit pocket (105) with the highest numbered odd page facing up.

This process repeats until all original pages have been copied—and again repeats for each copy set to be produced.

All of these copy sets reside in the exit pocket face up. The original document must be circulated to the document feeder's upper tray before it is restored to its correct page order, face up.

U.S. Pat. No. 4,278,344 discloses a FIFO document feeder (20) in which the original document stack is loaded face up into a tray (22), i.e., page 1 facing up. These sheets are bottom-fed, without inverting, to the copier's document glass (23). Here the even-numbered pages of the original set are copied (once for each page) in descending even-page order, and the copies thereof are stored in the FIFO duplex tray (108) image side down. The document sheets are then inverted and restacked in the document feeder tray, but with the even-numbered pages now facing up and in descending even-page number from the top to the bottom. However, the sheets of the original set are now in scrambled page order.

Now, the document set is circulated to the document glass, with sheet inversion, as many times as is necessary to make the requested number of copy sets—as the even numbered pages are copied, one at a time, from the highest numbered even page to the even page number "2".

These copies are also stacked in the duplex tray, even numbered pages facing down, and in ascending number order. After side-one of all of the requested sets have been accumulated in the duplex tray (note that the highest request number is limited by the maximum number of sheets that the duplex tray can hold), the document feeder feeds one original set with sheet inversion, such that the highest-numbered odd page is copied onto the blank side of the duplex-tray sheet which has the highest numbered even page on one side thereof—and so on until the first duplex copy set has been made.

As the first copy set is thus made, the original documents are returned to the document feeder tray inverted. At this time, the original set has been restored to its proper attitude, i.e., with the lowest numbered odd page face up.

Now the document feeder recirculates the original set, without inversion, as many times as needed to clear the duplex tray.

In the end, the original set resides face up in the document feeder tray, and the requested copy sets reside in the output (122 or 128) face up.

SUMMARY OF THE INVENTION

This invention provides an efficient method of handling both a collated multi-page duplex original document set, and the collated duplex copy sets which are made therefrom. The method enables an operator to handle all sets in a convenient manner while loading the document feeder and unloading the copier's exit tray. The document feeder handles the document sheets in a manner to maintain page sequence throughout the process.

As the initial step in the method, the original document is circulated to the copier's imaging station for copying. Only one copy is made of a like-side of each sheet, usually the odd-numbered pages thereof. These copies are stored in a sheet storage accumulator, called a duplex tray. The original document is restacked in its original collated state.

The original document is then again circulated for copying. However, this time two copies are made of the other side of the document sheets, i.e., the even-numbered pages thereof. One of these copies is made on the blank side of a sheet taken from the duplex tray, whereas the other copy is made on one side of a blank sheet. The sheets taken from the duplex tray are finished sheets, and these sheets are routed to a copy exit tray. The other sheets are stacked in the duplex tray. Again, the original document is restacked in a collated state.

The next circulation of the original document produces two copies of the odd-numbered pages, one copy on paper taken from the duplex tray, and the other copy on one side of a blank sheet. Again, the finished sheets are routed to the exit tray, and the other sheets are routed to the duplex tray, and again the original document is restacked in a collated state.

This process continues until production of the last copy set, whereupon only one copy of the appropriate side of the original document set is made on sheets which are taken from the duplex tray. This last copy set is routed to the exit tray.

All copy sets and the original document set are then in a proper collated page sequence, and can be removed by the operator.

The foregoing and other objects, features and advantages of the invention will be apparent from the following more particular description of the preferred embodiments of the invention, as illustrated in the accompanying drawing.

THE INVENTION

Figure 1:
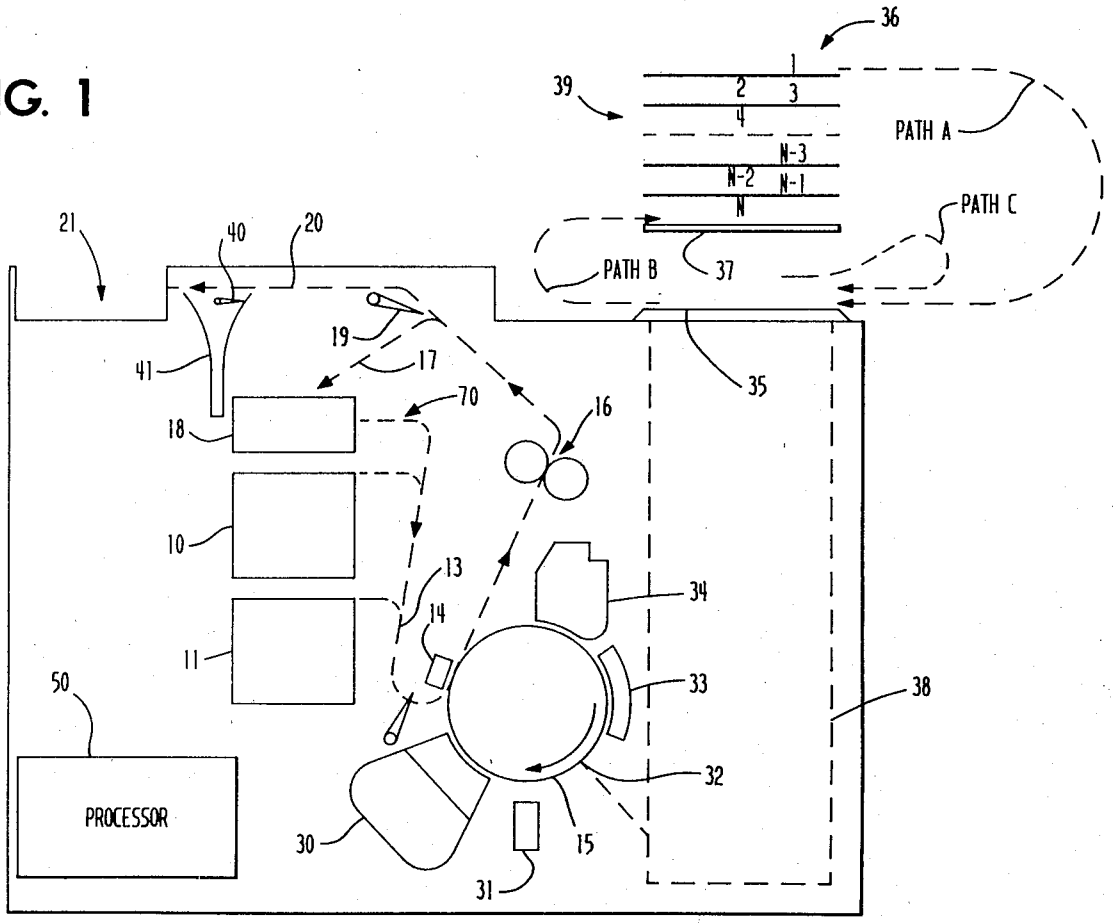
FIG. 1 shows a xerographic copier including the present invention.

A copier incorporating the present invention is shown in FIG. 1. This copier is of the type commercially known as the IBM Series III Copier/Duplicator.

The apparatus of FIG. 1 is capable of copying in a number of modes, such as simplex-original-to-simplex-copy, simplex-to-duplex, duplex-to-simplex and duplex-to-duplex. The manner in which the apparatus functions in the duplex-to-duplex mode is the subject of the present invention.

The components of this copier include two paper storage bins 10 and 11 which store unused or blank sheets of copy paper on which copies are formed by the well known xerographic process. Two bins are provided to facilitate selection of two different paper sizes, such as letter and legal size. The paper feeding mechanism used in bins 10 and 11, but without limitation thereto, is preferably of the type described in U.S. Pat. Nos. 4,089,516; 4,113,245 and 4,126,305, incorporated herein by reference.

A sheet of the selected paper follows path 13 to transfer station 14, where a toner image is transferred to one side of the paper from photoconductor drum 15. If a duplex copy is to be made, the copy sheet passes through hot roll fuser 16 and paper path 17 to first-in-first-out (FIFO) duplex tray 18.

The paper path of this copier is constructed and arranged such that the time interval which is needed in order to stage a sheet for feeding from one of the bins 10 or 11 is about one second (actually 800 milliseconds); the time for feeding the sheet through the aligned station which is resident in paper path section 13 is also about one second; the time for feeding the sheet from transfer station 14 to fuser 16 is about one second; the time for feeding the sheet from fuser 16 to duplex bin 18 is about one second; and the time necessary to stage a sheet for feeding out of the duplex tray is also about one second.

As will be explained in greater detail, FIFO tray 18 includes a follower finger sensor which moves downward as it follows the interface between sheets of the copy set then being processed, which sheets are under the finger, and sheets of the next copy set to be processed, which sheets are above the finger.

In order to place an image on the blank bottom side of a sheet of paper fed from the duplex tray (i.e., the downward facing side of such a sheet), the sheet is fed back to path 13.

Conventional process stations of the copier include magnetic brush developer 30, photoconductor erase lamps 31, imaging station 32, charge corona 33 and photoconductor cleaner 34.

The construction and arrangement of this particular copier is that the stationary page image which is to be copied resides on platen 35 with the image facing downward. An optics module 38, whose details are well known to those of skill in the art, enables that image to be projected onto the moving photoconductor drum at station 32.

Assuming that an original document's "page 1" and "page 2" are to be copied onto opposite sides of a single blank sheet of copy paper, a toner image of the original document's "page 1" is first transferred to one side of the blank sheet, the image is fused, and the sheet is routed to FIFO tray 18, with "page 1" facing up and the sheet's blank side facing down. The sheet is then again fed to transfer station 14, and an image of original document's "page 2" is placed on the blank side of the sheet. The sheet again passes through fuser 16, to fuse the image of "page 2". Now however, deflector 19 is positioned such that the sheet follows path 20 to exit bin 21. The sheet resides in bin 21 with "page 1" facing down, and "page 2" facing up.

As will be appreciated from the above description, when a multi-page duplex original document, comprising pages 1 through n for example, is copied, the original document is copied in its collated page sequence of page 1, page 2,—page n−1, page n (where n is an even number). The desired result of this copying is a collated duplex copy set in exit tray 21, which copy set faces down.

A recirculating automatic document feeder (RADF) 36 is provided to feed such a multi-page original document to the copier's document glass or platen 35 for copying. The art of document feeders has developed to the point where it is now necessary to describe feeder 36 only in its conceptual form. Those skilled in the art are aware of many ways in which the hardware details of such an RADF can be implemented.

RADF 36 is preferably of the type wherein a collated original document set is placed on stationary, horizontal tray or platform 37 with its odd-numbered "page 1" facing up, and with its even-numbered last page, i.e., "page n", facing down.

As will be described in greater detail, RADF 36 includes a follower finger sensor which moves upward as it follows the interface between the last sheet of the original document set and the first sheet of the set, as the set is circulated to platen 35 for copying. This interface comprises the first sheet of the set immediately under the finger, and the last sheet of the set immediately above the finger.

It is preferred that RADF 36 be of the top-feed, bottom-restack type in which sheets are fed from the top of original document stack 39, and sheets are returned from platen 35 to be restacked by feeding the sheet under the stack. Such an RADF can be found in U.S. Pat. Nos. 4,413,901 and 4,456,235, incorporated herein by reference.

For convenience, it will be assumed that all sheet sides of an original document contain images which must be copied in order to make a collated copy of the original document. However, this is not to be taken as a limitation on the present invention since it is not at all unusual that an original document will contain some blank pages, for example a blank last page, i.e., "page n", or a blank front cover or "page 1", as the page terminology is used herein.

Stack 39 is shown as having a number of sheets whose opposite image sides have been identified as pages 1, 2, 3, 4,—n−3, n−2, n−1 and n (where n is an even number). By definition, and in order to simplify a description of the present invention, all odd-numbered pages are considered to be like-images of a first type, and all even-numbered pages are considered to be like-images of a second or different type.

In accordance with the present invention, page 1 is first fed to platen 35, as the stack's top sheet follows PATH A. This sheet stops at the platen and is copied. Regardless of the number of collate copy sets which are to be made, page 1 is at this time copied only once, on one sheet of paper taken from bin 10, for example. This copy sheet is then stacked in FIFO duplex tray 18, page 1 side facing up.

The original document sheet is now removed from platen 35, and is placed at the bottom of the stack via PATH B. The page 1 side again faces up.

The top sheet of stack 39 is now the sheet which carries page 3 facing up. Again this sheet is fed to platen 35, where it is copied once, and the copy sheet if fed to FIFO tray 18. FIFO tray 18 now contains two sheets. The bottom sheet contains page 1 facing up, and the top sheet contains page 3 facing up.

In this manner, copying of original document set 39 continues until FIFO tray 18 contains n/2 sheets of paper, with all odd page images facing up in reverse collated sequence, i.e., the top sheet contains page n−1 facing up.

The present status of the process is that original document 39 has circulated through RADF 36 once and again resides on tray 37 in its original collated state, and n/2 collated copy sheets reside in FIFO tray 18 with odd-page images facing up, page 1 being on the bottom of the stack.

A feature of this invention is that as soon as a sheet has been placed in FIFO tray 18, that sheet is staged partially out of the duplex tray, for feeding to copier paper path 13. That is, the sheet is partially fed out of the duplex tray, i.e., its leading edge is staged into a paper feed nip which will subsequently be controlled to feed the sheet to path 13, as the sheet is needed in the synchronized copy process. This staging of the sheet out of the duplex tray is entirely independent of the copy process itself, and is dependent only upon the presence of a sheet in the duplex tray. In other words, if N sheets are to be consecutively fed into the duplex tray, as soon as the first of N sheets has been fed to the duplex tray, it is staged for feeding to paper path 13. In this way, the copy speed or throughput of the copier is maximized.

The next step in this duplex-to-duplex copy process is to again circulate original document set 39 to platen 35. This time the top sheet of the stack follows PATH A to the platen, momentarily stops at the platen without copying occurring, is fed through PATH C, to invert the sheet, and is returned to the platen with page 2 facing down. The sheet now stops, and two copies are made of page 2. One of these two copies is made on the blank side of a sheet taken from bin 10, whereas the other copy is made on a blank sheet of paper taken from FIFO tray 18.

The copy made on the FIFO sheet is routed to exit bin 21, whereas the copy made on blank paper is routed to FIFO tray 18, both effects being accomplished by changing the position of sheet deflector 19. Before this particular original document sheet can be returned to the bottom of stack 39, the sheet must be inverted. This is done by routing the sheet back through PATH C, across platen 35, and through PATH B, to the bottom of the stack. This sheet inversion occurs after the copying of all even-numbered pages for this circulation of the original document.

As will now be apparent, the copying of the original document's odd-numbered pages involves causing each sheet of the original document to follow the RADF path sequence (1) leave stack 39 via PATH A, (2) stop at platen 35 for copying, and (3) return to stack 39 via PATH B—whereas, copying of the original document's even-numbered pages causes each sheet to follow the RADF path sequence (1) leave stack 39 via PATH A, (2) momentarily stop at platen 35, but no copying occurs, (3) PATH C, (4) stop at platen 35 for copying, (5) PATH C, (6) pass over platen 35, and (7) return to stack 39 via PATH B.

This two-copy per image process continues for all even-numbered pages of original document set 39 have been copied. At the end of this process, i.e., after two images have been made of page n, the original document again resides on tray 37 in its original collated state, and FIFO tray contains n/2 sheets with even-numbered page n as the top sheet, facing up, and with even-numbered page 2 as the bottom sheet, facing up.

One collated copy set has now been produced, and it resides in exit bin 21 with page 1 facing down.

A feature of this invention is that when the copier is in the process of forming two copies of one original document image, the first copy is placed on unused paper taken from bin 10, for example. A copy is placed on one side of this unused sheet, and the sheet is placed in duplex tray 18. The next sheet to be picked is a sheet from FIFO duplex tray 18, and the same image is copied onto the blank side of this sheet. This sheet now has a copy on both sides of the sheet, and the sheet is now placed in exit bin 21. In this way, the copy speed or throughput of the copier is maximized.

As will now be appreciated, if the copy request was for only one copy set, the above-described two-copy per image process is not enabled. Rather, only one copy of each even-numbered page is made on the blank side of sheets taken from FIFO tray 18. Usually, more than one copy is requested, and this request may comprise an odd or an even number of copy sets.

Continuing with the assumption that more than one copy was requested, the next step in the process is to again circulate original document 39 to platen 35, one sheet at a time. This time, the sheets follow only PATH A to platen 35, where the sheets stop for the making of two copies of the odd-page images.

The first image is made on a sheet of blank or unused paper taken from bin 10. This sheet is fed to FIFO tray 18, where it resides with its page 1 side facing up.

The second of the two above-mentioned copies is made on the blank bottom surface of a sheet taken from FIFO tray 18. This particular sheet contains page 2 on its top surface, and thus, a copy sheet is formed having odd-numbered page 1 on one side, and even-numbered page 2 on the other side. Note, however, that in this case this sheet will reside in path 20 with odd image 1 facing up. In order to ensure the correct collated page sequence for the copy set, deflector 40 is positioned to send this sheet into sheet inverter 41. As the sheet moves into and out of the inverter, the sheet is inverted. Thus, the sheet exits the inverter, and enters exit bin 21, with odd-numbered page 1 facing down.

This process continues through all sheets of original document stack 39, with deflector 40 remaining in a position to send all sheets through inverter 41.

While it is advantageous to first use a new sheet from one of the bins 10 or 11, as above described, the present invention is not to be limited to this sequence of first using a new sheet, and then using a sheet from FIFO tray 18.

At the end of this process, two collated copy sets have been made, and the odd-page sides of the third copy set reside in FIFO tray 18. Of course, had only two copy sets been requested, the above-described second copy of the original document's odd-page images would not have been made, and FIFO tray 18 would now be empty since the copy request has been filled.

It will now be evident that when the copy request is for an even number of copy sets, all even numbered copy sets must be routed through inverter 41.

As those skilled in the art will appreciate, both RADF 36 and FIFO duplex tray 18 include a sensor which indicates when RADF tray 37 and FIFO tray 18 have been emptied of the sheets comprising an original document set or a copy set, respectively.

More specifically, and considering RADF 36, at any time in the middle of a circulation of original document stack 39 to platen 35, a mid portion of stack 39 will comprise an interface comprising "page n" sitting on top of "page 1". This stack interface is separated by an upwardly biased mechanical sensing finger which freely moves upward as this "page n/page 1" interface moves upward. When page 1 reaches the top of the stack, a circulation of stack set 39 has been completed. This condition is sensed by the aforesaid finger, called a follower finger, suddenly moving upward, due to release of the finger by the RADF feeding the sheet containing page n. The finger is set to the bottom of the stack, after page n has been restacked, in preparation for another excursion upward, following the "page n/page 1" interface.

A similar follower finger is provided in FIFO tray 18. However, in this case the finger follows a downward moving interface between the sheets of one copy set and the sheets of the next copy set. More specifically, in the case of a request for three collated copy sets, the first sheets to reside in FIFO tray 18 are the odd-page images of copy set one. As odd-page sheets from this set are fed one at a time from the bottom of tray 18, even-page sheets of the second copy set are being fed to the top of FIFO tray 18. The mechanical follower finger follows this "odd page/even page" interface down through the sheets, as "odd page" sheets of the first copy set are fed to transfer station 14 one at a time. When all of these sheets have been fed, the follower finger falls past a sensor and is reset to the top of the stack of second-copy-set "even page" sheets now in FIFO tray 18.

The signals provided by these two follower finger sensors control operation of deflector 40, and are used to determine how many copy sets have been made, and control operation of the aforesaid feeding path selection for RADF 36.

Operation of these two follower fingers is also monitored by the copier's control logic to insure that paper is fed properly from bins 10 and 11, and the RADF and the FIFO duplex tray. By monitoring operation of these two fingers, the control logic can determine that, for example, two sheets were fed simultaneously from the duplex tray, or that the count of the original document sheets received from one circulation does not agree with the count received from the first circulation of the original document. Another use of these fingers is to ensure that the same number of sheets are fed from both the RADF and the FIFO tray when producing one copy set. Due to physical limitations of the FIFO tray, the FIFO set size, i.e., the number of sheets contained in the set, is equal to one-half of the RADF set size, during simplex-to-duplex copying. When conditions such as these are not satisfied, an error is indicated. Other logical control use of these two follower fingers will be apparent to those skilled in the art.

A FIFO tray of this type, including such a sensing finger, is shown in copending U.S. patent application Ser. No. 672,226, filed Nov. 16, 1984, now U.S. Pat. No. 4,570,061, and assigned to the same assignee as the present invention. This copending application is incorporated herein by reference.

While the details of construction of this FIFO tray are not to be considered a limitation on the scope of this invention, a pre-feed feature associated with this tray is an important feature of this invention. More specifically, copier logic is provided to sense or determine when a sheet of paper has been fed to FIFO tray 18. In order to maximize the copy throughput, this sheet is substantially immediately staged, i.e., fed, such that its leading edge is positioned within sheet path 70. In this way, later, when making duplex copies as described herein, a duplex tray sheet is immediately ready for use, and time is not lost in the production of an image on the blank side of such a sheet.

In the duplex-to-duplex mode of operation, the operator loads a multi-page collated original document set into RADF tray 37 with page 1 face up. The RADF follower sensor is located below the set's bottom sheet. The FIFO tray follower finger is cycled to ensure that a sheet of paper is not in the FIFO tray. If a sheet is unexpectedly present in the FIFO tray, it may be automatically flushed to exit tray 21. The operator then enters copy request for a number of duplex copy sets by using the copier's control panel. This copy request may be for an even number or an odd number of cop sets.

The number of sheets in the original document set is unknown to the copier's control logic, usually a microprocessor. The only two possibilities are that the set contains an odd number of sheets or an even number of sheets. Copier logic is provided to count the number of sheets fed from the stack 39, as movement of the RADF's follower finger sensor is monitored. As soon as the last sheet of stack 39 has been fed, the follower finger is released, and the finger swings upward and then cycles back to the bottom of stack 39 after the last image of the original document set is copied, and that sheet has been restacked. The counter now contains the number of sheets in stack 39. This number also identifies that stack 39 has an odd or an even number of sheets.

Each time that feeding of the last sheet of the stack 39 is detected, a logic signal causes the follower finger in FIFO tray 18 to be reset to the top of sheets then in the FIFO tray when the copy of the last original has entered the FIFO tray.

First Pass:

During the first pass of stack 39, single-copies of the odd-page images of stack 39 are made, and are placed in reverse collated sequence, face up, in FIFO tray 18. All copies are made on blank sheets taken from one of bins 10 or 11.

The first sheet of the set is fed to platen 37 via PATH A, and one copy is made. The second sheet is then fed to the platen, via PATH A, as the first sheet is returned to the bottom of the stack via PATH B. This process continues until the RADF's follower finger is released, signaling that all sheets of stack 39 have been fed.

All odd page images of stack 39 have now been copied, and the collated copies thereof reside in FIFO tray 18, face up. The FIFO's follower finger has been cycled and now resides on top of the copy sheets in the FIFO tray.

Even-Page Intermediate Pass, and Last Pass of an Odd-Numbered Copy Request:

The next pass or circulation of stack 39 is called an even-page intermediate pass since the even-numbered images of stack 39 are copied and, depending upon the size of the copy request, a number of such passes may be made. If only one copy set is requested, the first even-page intermediate pass is in fact the last pass of stack 39 for copying. Usually, a copier of this type is used in a duplicating department or the like, and more than one copy set is requested.

Even-page intermediate passes of stack 39 double-copy only the stack's even-numbered pages. One copy is made on the blank side of a blank sheet taken from one of the bins 10 or 11. This sheet is deposited in FIFO tray 18, on top of the tray's follower finger. The other copy is made on a sheet taken from FIFO tray 18. This sheet is deposited in exit tray 21.

An exception to the above statement is the last pass of stack 39 where an odd number of collated copy sets have been requested. In this case, the even-page pass is the last pass of stack 39, and only one copy of the even-numbered pages is made on the blank side of sheets taken from FIFO tray 18. These sheets are routed to exit tray 21, where they reside in collated page sequence, side 1 facing down, as the last copy set of the requested number of sets.

An even-page intermediate pass begins by feeding the stack's top sheet via PATH A. The sheet stops only momentarily at platen 37, whereupon the document reverses direction and travels through PATH C, returning to the platen inverted, with page 2 facing down. Two copies of this image are made, one on blank paper taken from one of bins 10 or 11, and the other on paper taken from FIFO tray 18.

The sheet taken from the FIFO tray is now a finished sheet, and is fed to output tray 21. The blank sheet contains an image of page 2 on one side thereof, and is fed to the FIFO tray where it resides on top of the follower finger.

In preparation for feeding the second sheet from stack 39, the first sheet is first fed from the platen through PATH C, to again invert the sheet. This sheet quickly passes across platen 37, and returns to the bottom of stack 39 via PATH B, where the sheet arrives in its proper collated orientation, page 1 facing up.

As soon as this first sheet has cleared PATH C, feeding of the stack's second sheet begins, again via PATH A, the platen, reversing to PATH C to invert the sheet, and back to the platen where the sheet stops for two-copy copying. As before, one copy is made on blank paper, and a second copy is made on a sheet taken from FIFO tray 18. The sheets are routed to exit tray 21 and FIFO tray 18 as described.

This process continues until all even-numbered images of stack 39 have been copied. The end of this even-page intermediate pass is indicated by the RADF's follower finger being released by feeding the last sheet of stack 39. This follower finger now resets to the bottom of stack 39. As a result, the FIFO's follower finger is reset to the top of the sheets now in the FIFO tray when the copy of the last original image has entered the FIFO tray.

Exit tray 21 now contains one collated copy set, side 1 image face down. The FIFO tray contains the collated even-numbered page images of the second copy set, image face up.

Odd-Page Intermediate Pass, and Last Pass of an Even-Number Copy Request:

In an odd-page intermediate pass, the sheets of stack 39 are fed, one at a time, to platen 35 for two-copy copying. The sheets pass through PATH A to the platen, where they stop for copying. One copy is made on one side of a blank sheet. This sheet is routed to FIFO tray 18, where it resides on top of the follower finger, image facing up. The other copy is made on the blank side of a sheet taken from FIFO tray 18. This sheet is routed to exit tray 21. The original document sheet then returns to the bottom of stack 39 via PATH B, in proper page sequence, as the next sheet is fed to the platen via PATH A. An exception to the above statement is the last pass of an even-number copy request. In this case, the odd-page pass is the last pass of stack 39 for copying, and one copy is made on the blank side of sheets taken from FIFO tray 18. These finished sheets are routed to exit tray 21.

As before, copying of the last sheet of original document stack 39 is indicated by the RADF's follower finger being released so that the finger may travel upward and then return to the bottom of stack 39. This operation causes the FIFO's follower finger to be reset to the top of the sheets then in FIFO tray 18.

As will be appreciated, the above process continues until all requested copy sets have been made. As described above, the last pass of original document set 39 for copying is a modified version of an intermediate pass, where only one copy is made on paper from the FIFO tray.

The copier's control logic comprises a microprocessor 50 which, in a manner well known to those of skill in the art, controls all of the various processes of the copier, including the method of the present invention. One skilled in the art is enabled by the above description to program processor 50 in order to provide the method of the present invention.

Figure 2:
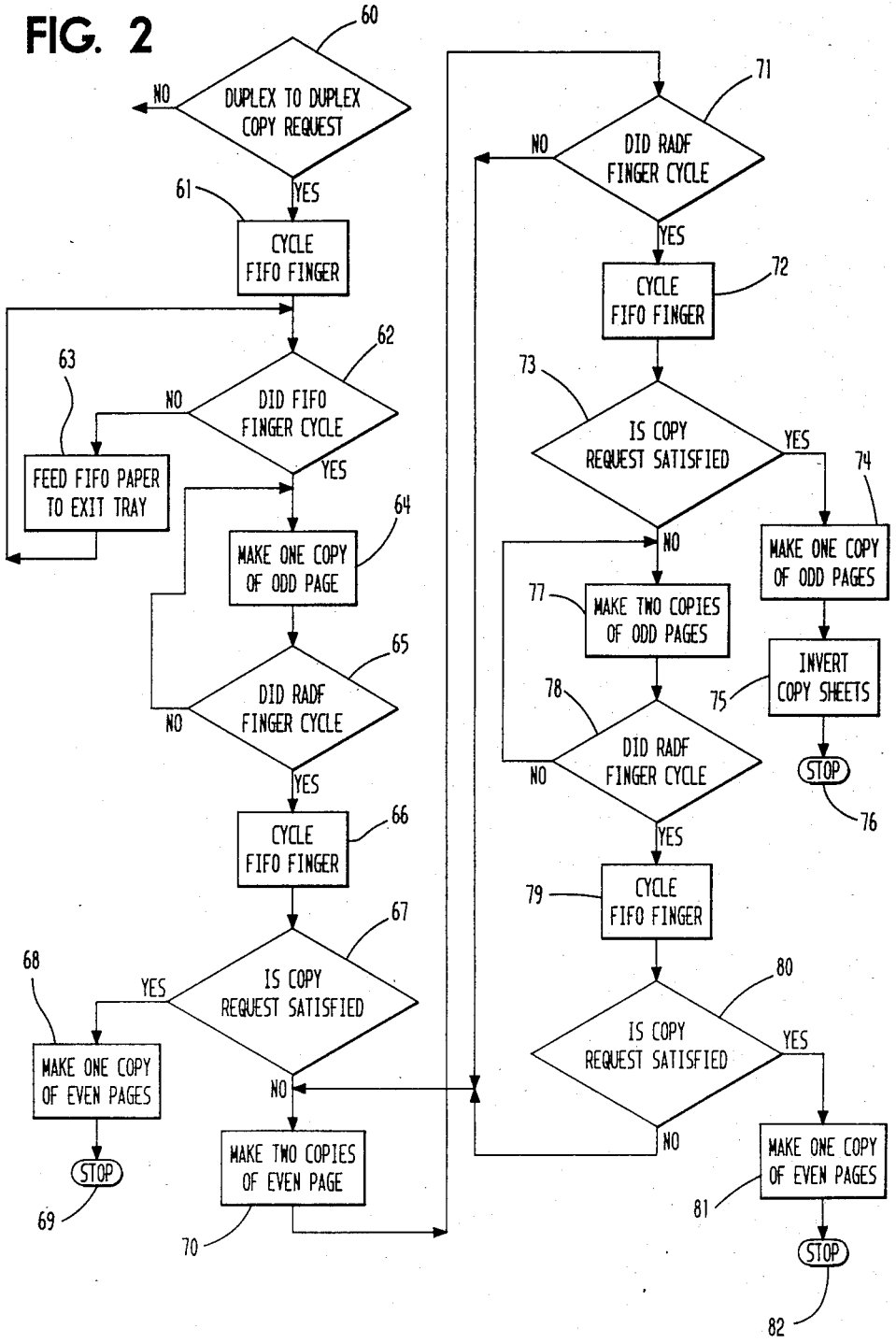
FIG. 2 is a program flow chart disclosing the present invention.

FIG. 2 discloses a program module flowchart which implements the present invention. As disclosed by program decision block 60, entry to this program module is conditioned upon a request by the operator that duplex copies be made of a duplex original document.

When this is the case, the FIFO tray's follower finger is cycled (block 61) to ensure that the tray does not contain paper. If it does (block 62), the sheet(s) may be automatically fed to the exit tray (block 63).

When the FIFO tray is clear of paper, the original document's odd-numbered pages are copied once (block 64). This copying continues until the RADF follower finger cycles (block 65), whereupon the FIFO finger is cycled (block 66) to place the finger on top of the sheets in the FIFO tray.

At this time the program module inquires to see if the copy request has been satisfied (block 67). The request will have been satisfied at this time only if the request was for one copy, in which case one copy of the document's even-numbered pages is made (block 68), after which the process stops (block 69).

Usually, the copy request is for more than one copy, and double copying of the document's even pages now begins (block 70). Again this copying continues until the RADF follower finger cycles (block 71). As a result, the FIFO follower finger is now cycled (block 72) to place the finger in top of the sheets within the FIFO tray.

The program module again inquires as to the status of the copy job relative to the number of sets which have been made (block 73). If the copy request was for two copies, the original document is circulated, and one copy of each odd page is made (block 74). These sheets are inverted on their way to the exit tray (block 75), and copying then stops (block 76).

If the copy set request has not been satisfied, double copying of the document's odd pages begins (block 77), and continues until the RADF follower finger cycles (block 78). When all odd pages have been copied, the FIFO finger is cycled (block 79), and the program makes inquiry as to the status of the copy job (block 80).

If the request has been satisfied, one copy of the document's even pages is made (block 81), whereupon copying stops (block 82). If the copy request has not been satisfied, the program module continues by enabling double copying of the document's even pages (block 70).

Figure 3:
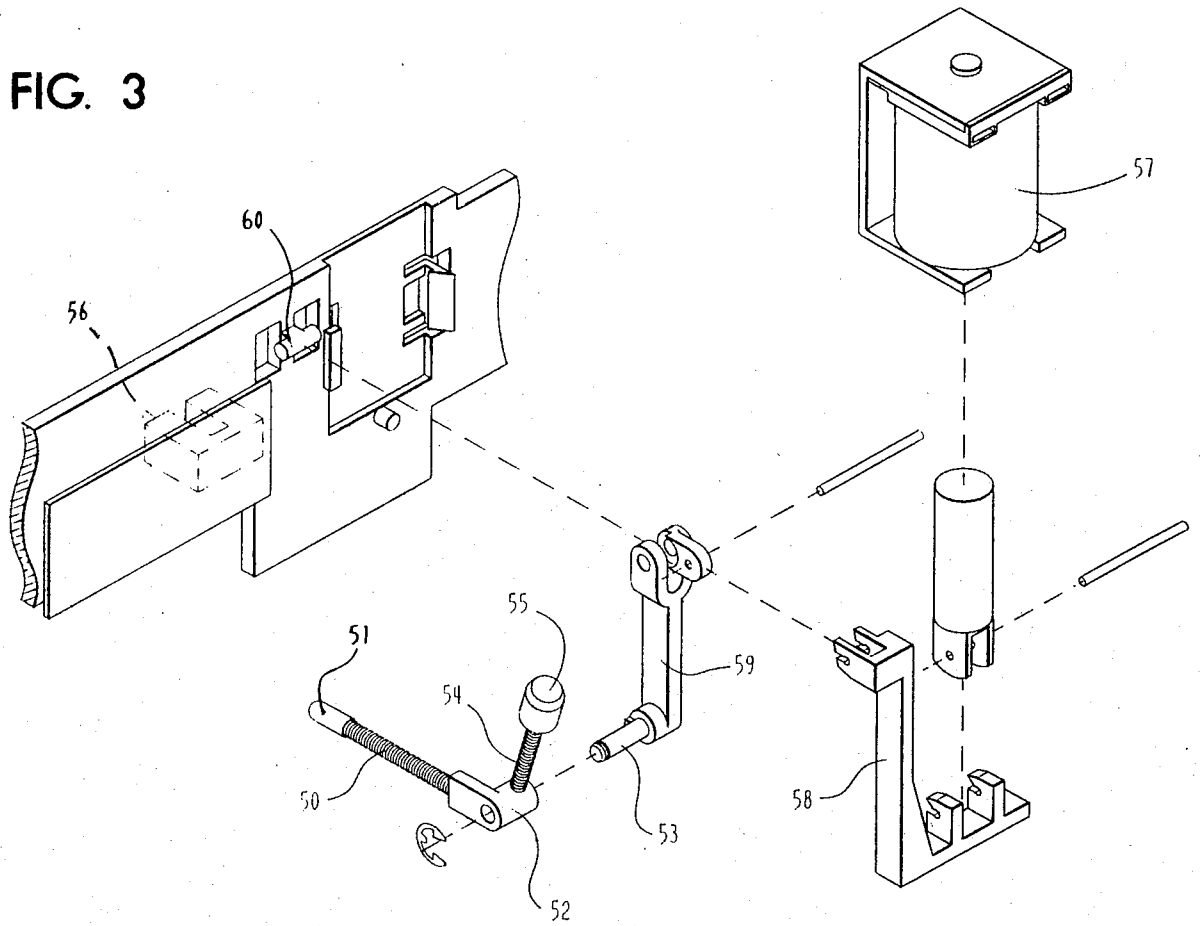
FIGS. 3 and 4A through 4D show an exemplary follower finger for use in the RADF of FIG. 1.

The construction and arrangement of an exemplary follower finger for use in RADF 36 is shown in FIGS. 3 and 4. Other finger constructions will be apparent to those of skill in the art, and the present invention is not to be limited to this disclosed arrangement.

The follower finger, which moves upward through the stack as documents are fed for copying, comprises a small, light weight coil spring 50 which terminates in a plastic plug 51. Spring 50 is mounted to a plastic member 52 which freely pivots on shaft 53. A second coil spring 54 also mounts on member 52, and this spring terminates in a metal weight 55. Springs 50 and 54 are mounted to form an angle greater than a right angle.

Figure 4A:
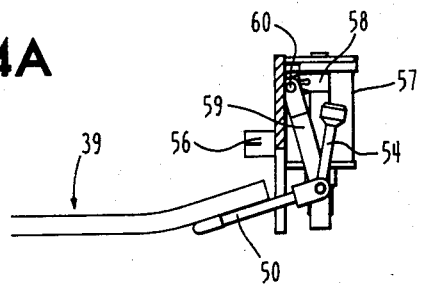
Figure 4B:
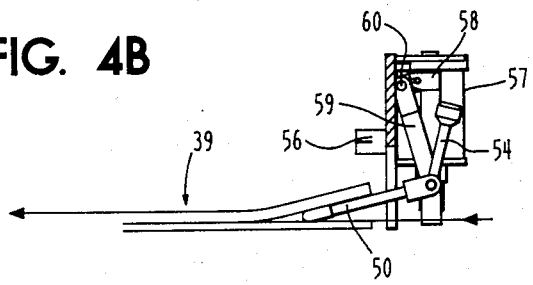

So long as at least one sheet of paper exists above spring 50, the follower finger remains in the position shown in FIG. 4B, with spring 50 extending in a generally horizontal direction, under the sheet. However, when the last sheet is removed (FIG. 4C), weight 55 operates to cause member 52, and springs 50 and 54, to pivot about shaft 53, due to the influence of gravity on weight 55. In the FIG. 4C position, springs 50 and 54 both extend generally 45° to a horizontal plane. A stop, associated with sensor 56, is provided for spring 50 and operates to hold the follower finger assembly in the FIG. 4C position.

Figure 4C:
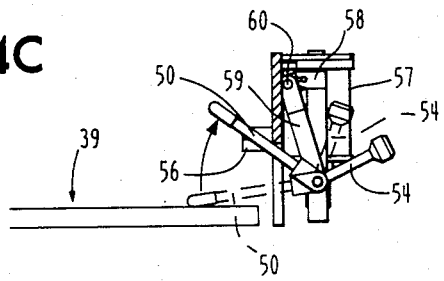

Movement from the FIG. 4B to the FIG. 4C position causes spring 50 to pass in front of sensor 56, signaling that the last sheet of stack 39 has been fed for copying.

After the last sheet of stack 39 has been returned to tray 37, solenoid 57 is energized. This solenoid operates to reset spring 50 under the last sheet of the stack (FIG. 4A).

Figure 4D:
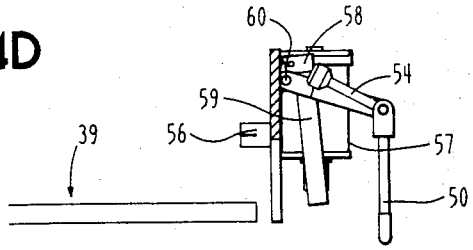

Energization of this solenoid is maintained for a short time interval, about 500 milliseconds, and operates to raise and hold link 58 at its upper position for the duration of this interval (FIG. 4D). The upper end of link 58 is pivotally connected to a second link 59. As link 58 moves upward, link 59 is caused to rotate about fixed-position pivot 60. This pivoting movement of link 59 causes the link to move to a substantially horizontal position (FIG. 4D). In this position, weight 55 operates to cause spring 54 to move to a generally horizontal position, and spring 50 to move to a generally vertical position.

Spring 50 is now positioned with its end plug 51 pointed down (FIG. 4D), poised to be inserted under stack 39. When solenoid 57 is subsequently deenergized, link 59 drops to assume a generally vertical position, link 59 assumes a generally vertical position, and weight 55 operates to rotate member 52 such that finger 50 is inserted under stack 39 (FIG. 4A). Stack 39 can now be recirculated for copying.

While this invention has been particularly shown and described with reference to preferred embodiments thereof, it will be understood by those skilled in the art that various changes in form and detail may be made therein without departing from the spirit and scope of this invention.

What is claimed is:

1. A method of duplex-to-duplex copying which comprises copying both sides of a collated duplex original document set of N sheets, in order to produce M collated duplex copy sets of said original document set, comprising the steps of:

a. circulating each of said N sheets sequentially to an imaging station, and producing one copy of like-sides of each of said N sheets, each copy being produced on a sheet of blank copy substrate;

b. supplying the substrate sheets processed in step-a to a sheet accumulator, to thereby form a stack of N copy sheets, each sheet having an image thereof;

c. circulating each of said N sheets sequentially to said imaging station and producing two copies of the opposite side of each of said N sheets, one of said two copies being produced on the blank side of a sheet taken from said accumulator, and the other copy being produced on a sheet of blank copy substrate;

d. supplying the substrate sheets taken from the accumulator in step-c to an output means, to thereby complete the making of a copy set, and supplying the copies made on said blank copy substrate in step-c to said accumulator;

e. circulating each of said N sheets sequentially to said imaging station and producing two copies of said like-sides, one of said two copies being produced on the blank side of a sheet taken from said accumulator, and the other copy being produced on a sheet of blank copy substrate;

f. supplying the substrate sheets taken from the accumulator in step-e to said output means, to thereby complete the making of a copy set, and supplying the copies made on said blank copy substrate in step-e to said accumulator;

g. repeating step-c through step-f until M−1 copy sets have been made;

h. circulating each of said N sheets sequentially to said imaging station and producing one copy of the appropriate side of each of said N sheets on the blank side of a sheet taken from said accumulator; and i. supplying the substrate sheets taken from said accumulator in step-h to said output means, to thereby complete the making of the Mth copy set.

2. The method defined in claim 1, including the step of inverting one of the sets of completed sheets supplied to said output means in step-d or step-f, to thereby cause all copy sets in said output means to be page oriented in the same direction.

3. The method defined in claim 1 wherein said step-c causes the first of said two copies to be produced on said sheet of blank copy substrate, and causes the second copy to be produced on said blank side of a sheet taken from said accumulator.

4. The method defined in claim 3, including the step of providing a first-in-first-out duplex tray as said accumulator, such that copies which were supplied to said accumulator in step-b, step-d and step-f are supplied from the output of said accumulator for making the copies of step-c, step-e and step-g, respectively, as the copies produced on blank copy substrate in step-d and step-f are supplied to the input of said accumulator.

5. The method defined in claim 4 including the steps of determining when sheets reside in said duplex tray, and partially prefeeding a sheet from said duplex tray upon making said determination.

6. A method for producing duplex copy sets from a duplex original document set, comprising:

providing a first-in-first-out duplex storage bin for copy sheets having an image on one side thereof;

providing a top feed/bottom restack recirculating document feeder having a document inverter, said document feeder operating to circulate said original document to a copying station, one sheet at a time, and said document feeder having a generally horizontal tray for supporting said original document set;

placing said original document set on the tray of said document feeder in page 1—page n sequence, where n is an even number, with page 1 facing up;

circulating said original document set to a copying station and producing one copy of the odd pages thereof in the page sequence page 1—page n−1, and on blank copy paper;

supplying said odd pages copies to said duplex bin in the page sequence page 1—page n−1;

circulating said original document set to said inverter and then to said copying station, and producing two copies of the even pages thereof in the page sequence pairs page 2, page 2—page n, page n, one of sid copies of each of said pairs being produced on the blank side of paper taken from the output of said duplex bin in the page sequence page 1—page n−1, and the other copy being produced on blank copy paper;

supplying the copies made on sheets taken from said duplex bin to an exit tray to produce a collated copy set, and supplying the copies made on blank paper to the input of said duplex bin in the page sequence page 2—page n;

circulating said original document set to said copying station and producing two copies of the odd pages thereof in the page sequence pairs page 1, page 1—page n−1, page n−1, one of said copies of each pair being produced on the blank side of paper taken from the output of said duplex bin, and the other copy being produced on blank copy paper;

supplying the copies made on sheets taken from said duplex bin to said exit tray to produce a second collated copy set, and supplying the copies made on blank paper to the input of said duplex bin in the page sequence page 1—page n−1; and as the final circulation of said original document set to said copying station, circulating said original document to said copying station and copying once in page sequence the odd or even pages of said original document which complement the even or odd pages which exist on the sheets then within said duplex bin, said copies being produced on sheets taken from said duplex bin.

7. The method of claim 6 including the step of inverting alternate ones of the copy set sheets supplied to said exit tray, in order to produce a stack of copy sets having the same page orientation.

8. The method defined in claim 6 wherein the first of said two copies is produced on the blank side of paper taken from the output of sid duplex bin, and the second of said two copies is produced on blank copy paper.

9. The method defined in claim 8 including the steps of determining when a copy sheet resides in said duplex storage bin, and prefeeding such a copy sheet from said duplex storage bin when such a determination is made, to thereby shorten the time needed to feed sheets from said duplex storage bin.

* * * * *